United States Patent [19]

Markum et al.

[11] 4,182,948

[45] Jan. 8, 1980

[54] ELECTRIC HEATING ELEMENTS

[75] Inventors: Thomas R. Markum; Charles E. Bryson, Jr., both of Murfreesboro, Tenn.

[73] Assignee: Emerson Electric Co., St. Louis, Mo.

[21] Appl. No.: 926,854

[22] Filed: Jul. 21, 1978

[51] Int. Cl.[2] ..... H05B 3/08

[52] U.S. Cl. ..... 219/541; 219/451; 219/552; 338/274; 339/256 SP

[58] Field of Search ..... 219/335, 451, 523, 535, 219/541, 544, 467, 448, 403, 446, 447, 455, 552; 29/611; 339/32 R, 14 L, 217 S, 256 SP, 263 R, 258 R, 258 F, 217 PS, 217 TR, 238, 242; 338/273, 274

[56] References Cited

U.S. PATENT DOCUMENTS

| | | | |
|---|---|---|---|
| 2,600,188 | 6/1952 | Batcheller | 339/256 SP |
| 2,666,189 | 1/1954 | Cook | 339/263 R X |
| 2,683,795 | 7/1954 | Sheidler et al. | 219/403 X |
| 2,742,628 | 4/1956 | Batcheller | 339/256 SP |
| 2,760,173 | 8/1956 | Cunningham | 339/256 SP X |
| 3,087,042 | 4/1964 | Hanson | 219/451 |
| 3,132,229 | 5/1964 | Bremer et al. | 219/448 |
| 3,206,704 | 9/1965 | Hay | 338/274 X |
| 3,331,944 | 7/1967 | Burger et al. | 219/455 |
| 3,617,703 | 11/1971 | Ewart, Jr. | 219/451 |
| 3,717,841 | 2/1973 | Mancini | 339/258 F |
| 3,943,328 | 3/1976 | Cunningham | 219/523 X |

FOREIGN PATENT DOCUMENTS

| | | | |
|---|---|---|---|
| 1311445 | 10/1962 | France | 219/447 |

*Primary Examiner*—Volodymyr Y. Mayewsky
*Attorney, Agent, or Firm*—Michael Williams

[57] ABSTRACT

An electric heating element of the type having a metal tubular sheath, a resistance conductor within the sheath, a terminal pin connected to an end of the resistance conductor and having an outer end projecting outwardly of the open end of the sheath, electric-insulating, heat-conducting material holding the resistance conductor and terminal pin spaced from the inner surface of the sheath; the improvement comprising a spade-type terminal on the outer end of the terminal pin, the spade-type terminal being formed as an integral part of the terminal pin by a coining die operation.

1 Claim, 4 Drawing Figures

ELECTRIC HEATING ELEMENTS

BACKGROUND AND SUMMARY

Tubular electric heating elements of the prior art have had electric terminations of various types. In some cases a conductor (for connecting the heating element to a source of electrical energy) was secured to the terminal pin in various manners, such as by welding, crimping, or by a nut threaded on screw threads formed on the outer end of the terminal pin.

However, because of the need for quick connection and disconnection of a conductor to the terminal pin, spade-like terminals were welded to the outer end of the terminal pin so that a complementary female terminal (to which the conductor is connected) may be easily connected thereto or disconnected therefrom. Terminals of this type are made and sold by Ark-Les, Amp, Essex, Tomson-Betts and others.

However, welding of a spade-like terminal to the end of a terminal pin increased the cost of manufacture in that it includes the cost of the terminals and their handling, and the cost of welding the terminals to the end of the terminal pin. Welding of the spade-like terminals to the terminal pin required care on the part of the operator to insure that the weld was proper so that the spade-like terminals did not separate from the terminal pin during handling and shipment of the electric heating element, or the apparatus in which it was incorporated. Further, welding sometimes resulted in welded splatter on the spade-like terminal and such splatter in many cases had to be removed so that there would be no interference when the female terminal was connected to the male terminal. Also, welding in many cases adversely affected the nickel plating which is usually applied to terminal pins.

Our invention overcomes all of the disadvantages noted above and comprises the forming of a spade-like (male) terminal as an integral part of the terminal pin of the electric heating element.

DESCRIPTION OF THE DRAWING

In the drawing accompanying this specification and forming a part of this application there is shown, for purpose of illustration, an embodiment which our invention may assume, and in this drawing.

DESCRIPTION OF THE PREFERRED EMBODIMENT

In accordance with conventional manufacturing practice, a rectilinear metal tube 10 has a coiled resistance wire 11 disposed therein, each end of the coil having a terminal pin 12 electrically connected thereto. The terminal pin may be formed of cold rolled steel and preferably is nickel plated in order to improve electrical conductivity.

The wire coil and terminal pins are held centrally within the tube 10 in any suitable manner and the space within the tube is filled with heat-conducting, electrical-insulating material such as granular magnesium oxide. Bushings 14 are then tightly pressed into the ends of the tube 10 to prevent the magnesium oxide from escaping.

Figure 1:
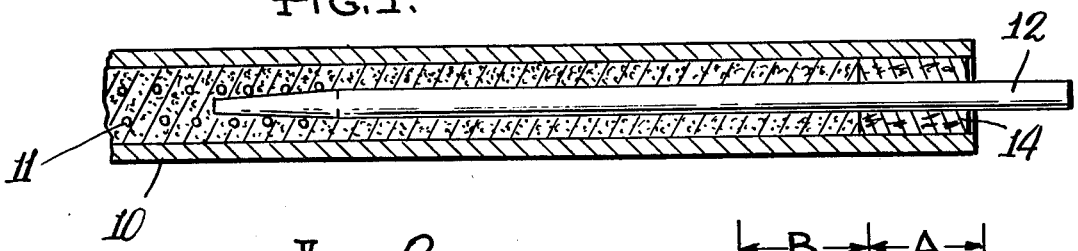
FIG. 1 is a fragmentary, longitudinal sectional view of a tubular electric heating element, showing a stage in its manufacture.
Figure 2:
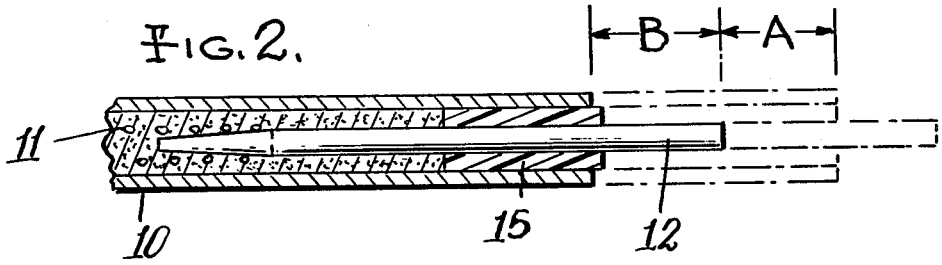
FIG. 2 is a view similar to FIG. 1, showing a further stage in the manufacture.

The heating element thus far produced is subjected to a rolling or swaging operation to reduce its transverse section (as seen in FIG. 2) and thereby densify the magnesium oxide to an almost rock-line condition. This rolling or swaging operation also reduces the diameter of the terminal pin, except for that part seen in FIG. 1 which extends outwardly of the tube end. As an example of the amount of reduction, the terminal pin 12 shown in FIG. 1 has an outside diameter of 0.109 inches (about 2.778 millimeters) and after rolling or swagging has an outside diameter of 0.104 inches (about 2.520 millimeters).

In accordance with normal practice, each end of the tube 10 is then cropped to remove the end and pin portion shown by the dimension "A" in FIG. 2, and to simultaneously remove the bushing 14. Each end of the tube 10 is then end trimmed to remove the amount of sheath shown by the dimension "B" and to remove the magnesium oxide therein, but without affecting the terminal pin 12, The end trimming results in a precise amount of terminal pin extension from the trimmed end of the tube or sheath. Thereafter, a certain amount of magnesium oxide is removed from the end of the tube and a bushing 15 is forced into the space so provided. The bushing 15 may be formed of polystyrene material. Sometimes the tube 10 is subjected to an end pressing operation to lock the bushing within the tube end. Normally, the outer end of the bushing 15 extends slightly beyond the end of the tube to provide a satisfactory electrical creepage path from terminal pin to metal tube.

Figure 3:
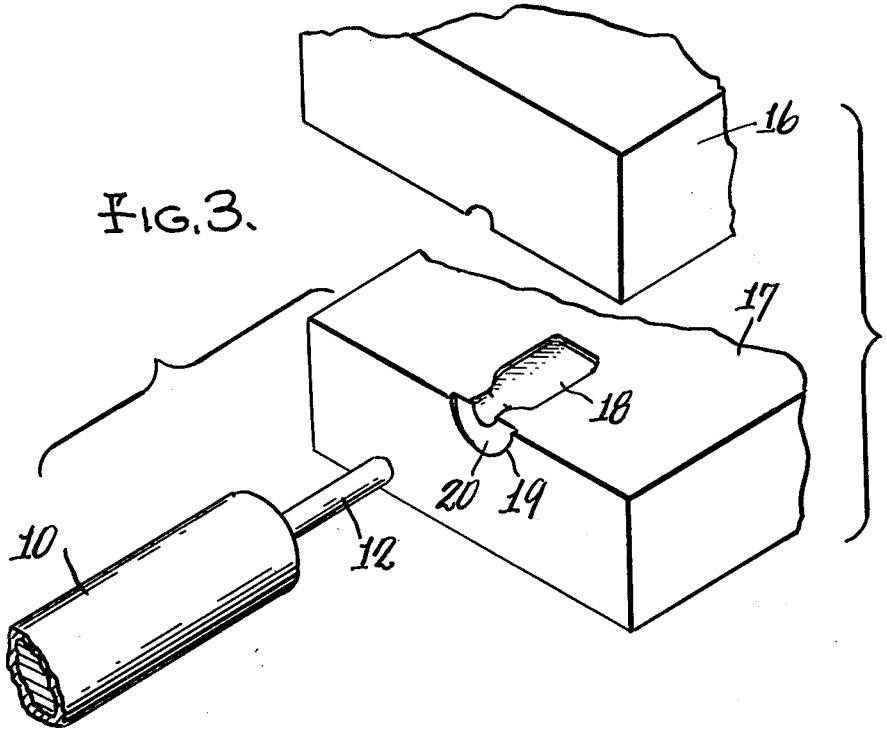
FIG. 3 is a fragmentary, perspective view showing an end of an electric heating element and a coining die.
Figure 4:
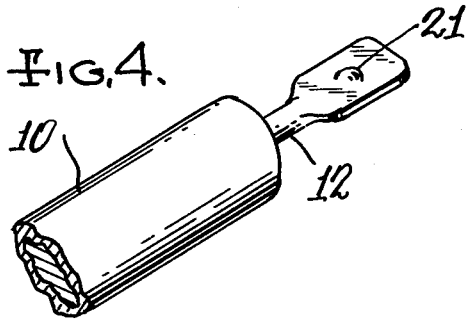
FIG. 4 is a fragmentary perspective view showing an electric heating element with an integral spade-like terminal.

The projecting end of the terminal pin 12 (as seen in FIG. 3) is then disposed within the cavity of a coining die for formation into the shape of a spade-like male connection-member. The coining die may be formed as a pair of metal blocks 16 and 17, mounted in a die set (not shown) for movement one toward the other. Each of the blocks has a recess 18 therein to provide the desired spade shape, the recesses being complementary so that when the blocks are closed on each other, the die cavity is the exact shape, length and thickness of the spade configuration.

Since the end trimming operation provides a terminal pin extension of predetermined length, one or both of the die blocks may have an end recess 19 to provide clearance for the extending end of the bushing 15 and to provide a face 20 against which the end of the tube may abut to accurately dispose the terminal pin end within the die recess 18. In some cases it may be necessary to anneal the end of the terminal pin prior to coining, such as when the rolling or swaging of the heating element produces excessive work hardening of the terminal pin. The coining die recess 18 may also include cooperating surfaces to produce a dimple 21, or similar means conventionally used to connect the male and female parts with a snap action.

For some heater applications, it is not required to crop and end trim the end of the tube 10, and in such cases the spade terminal is formed on the projecting end of the terminal pin after the swaging or rolling operation. In other cases, after cropping and end trimming, the magnesium oxide is not removed from the end of the tube 10 since no bushing is required.

We claim:

1. An electric heating element, comprising a tubular metal sheath, a resistance conductor within said sheath and having a solid, round metal terminal pin centrally positioned in said sheath and electrically connected to an end of said resistance conductor, an integral end portion of said terminal pin extending outwardly of an end of said sheath, insulating material within said sheath for holding said resistance conductor and said terminal pin spaced from the inner wall surface of said sheath and for conducting heat from said resistance conductor to said sheath, and a spade-like male terminal comprising a coined deformation of the end of said extending terminal pin end portion and a dimple substantially in the middle portion of the spade-like male terminal, adapted for snap-action connection to a female terminal to which a power conductor is connected.

* * * * *